United States Patent [19]

Bigelow, Jr. et al.

[11] Patent Number: 4,574,533

[45] Date of Patent: Mar. 11, 1986

[54] PORTABLE HOME

[76] Inventors: Floyd E. Bigelow, Jr., 10802 Pine Bayou, Houston, Tex. 77024; Floyd E. Bigelow, III, 7903 Midland Forest, Houston, Tex. 77088; William H. Bigelow, 6903 Oakwood Grove, Houston, Tex. 77040

[21] Appl. No.: 577,269

[22] Filed: Feb. 6, 1984

[51] Int. Cl.[4] ..... B65D 85/00; E04H 1/02; A47K 3/16

[52] U.S. Cl. ..... 52/34; 52/173 R; 52/234

[58] Field of Search ..... 52/34, 35, 234, 173 R

[56] References Cited

U.S. PATENT DOCUMENTS

| | | | |
|---|---|---|---|
| 2,168,725 | 8/1939 | Whelan | 52/35 X |
| 2,665,454 | 1/1954 | Krenov | 52/34 X |
| 3,243,929 | 4/1966 | Strandlund et al. | 52/234 |
| 3,492,767 | 2/1970 | Pincus | 52/34 X |
| 3,620,246 | 11/1971 | Shoquist | 52/34 X |
| 4,327,529 | 5/1982 | Bigelow, Jr. | 52/34 |

OTHER PUBLICATIONS

American Builder, Aug. 1951, pp. 92–99.

*Primary Examiner*—Alfred C. Perham
*Attorney, Agent, or Firm*—Vinson & Elkins

[57] ABSTRACT

A dwelling in which the utilities are built around a small core room with a bath arranged to either side of the core room and a kitchen arranged adjacent one bath so that all sewer lines may extend from the various facilities to a main single sewer line in the core. The core also provides for a water heater, air conditioning equipment, as well as water lines to the various facilities.

3 Claims, 5 Drawing Figures

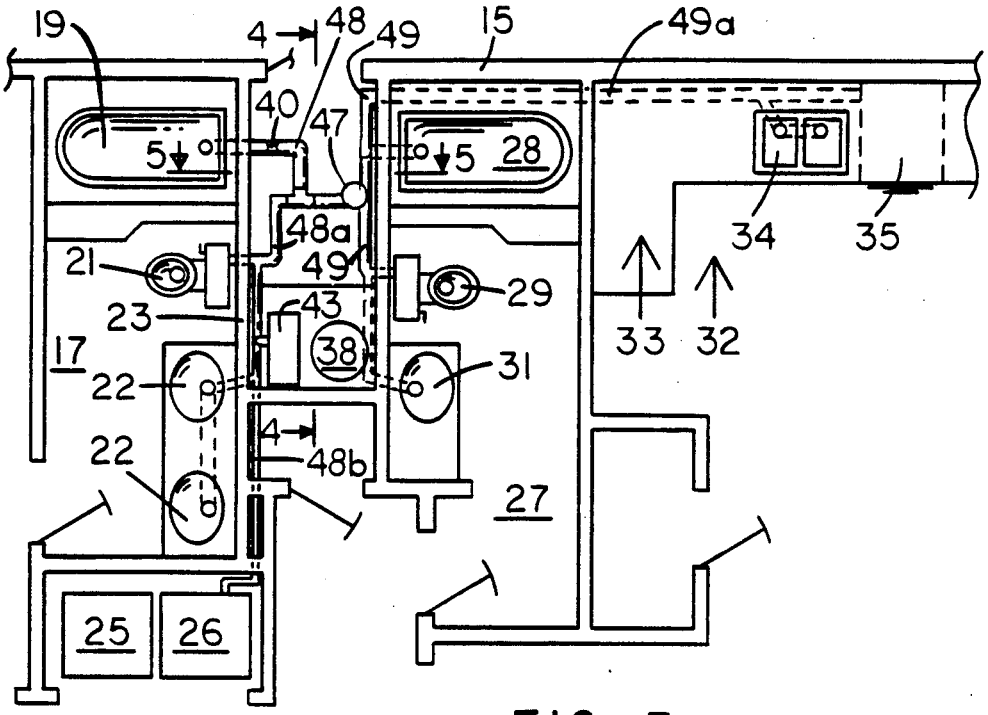
FIG. 3
FIG. 4
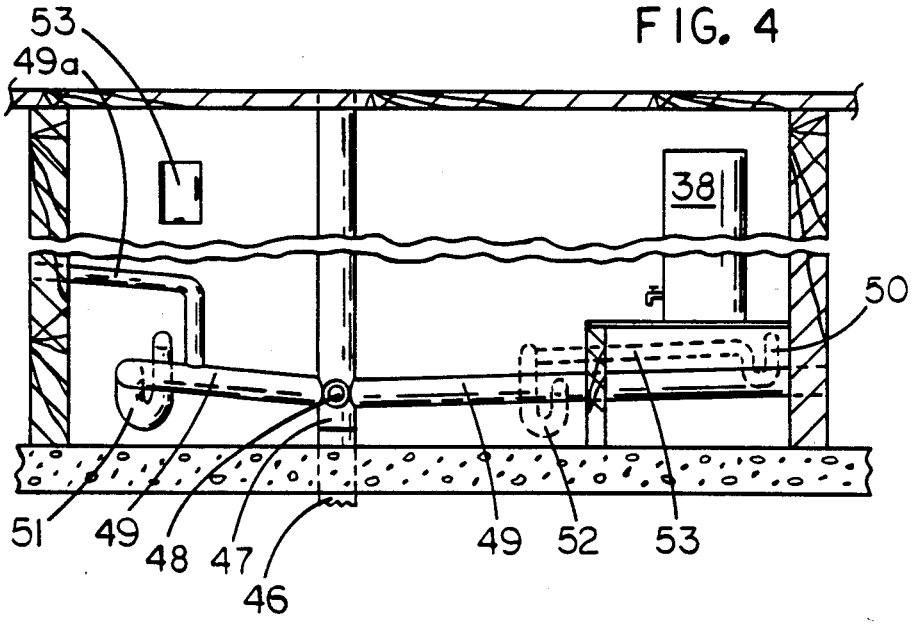

PORTABLE HOME

This invention relates to dwellings and more particularly to a dwelling with a sewage system centered around a core module.

Utility core units have been proposed in the past. See Lankton U.S. Pat. No. 2,419,319 which utilizes a core in conjunction with a kitchen and a single bath. There has not, however, been available in the past a dwelling design in which two baths and a kitchen are arranged around a core in such manner that a single main sewer line receives all waste from the two baths and kitchen.

It is an object of this invention to provide a dwelling having two baths and a kitchen with a single main sewer line in the core receiving waste from both baths and the kitchen.

Other objects, features and advantages of this invention will be apparent from the drawings, the specification and the claims.

In the drawings wherein illustrative embodiments of this invention are shown and wherein like reference numerals indicate like parts:

FIG. 3 is a view similar to FIG. 2 illustrating the sewage connection of the various facilities to the main sewer line;

FIG. 4 is a view along the lines 4—4 of FIG. 3; and

Figure 1:
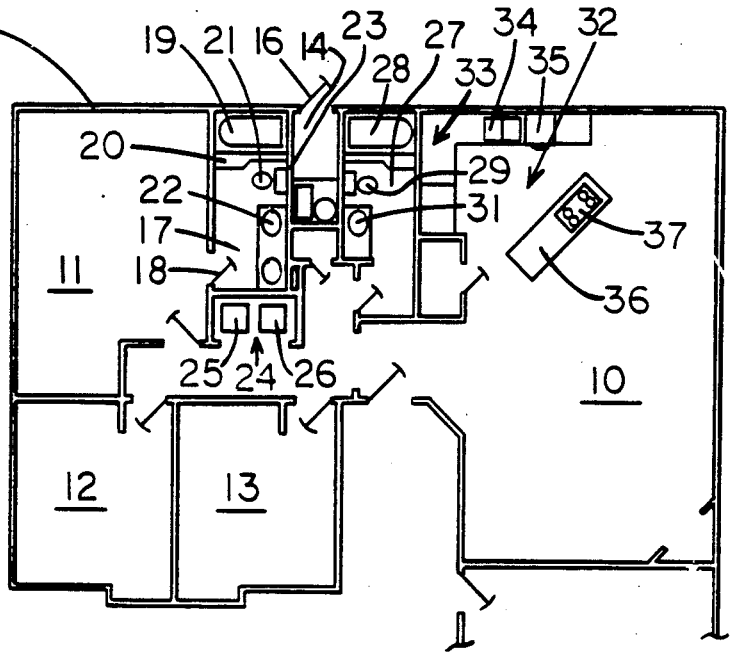
FIG. 1 is a plan view of a dwelling constructed in accordance with this invention.

The dwelling illustrated includes a family room 10, a master bedroom 11 and two smaller bedrooms 12 and 13.

The dwelling is built around a core 14 located on the exterior wall 15 of the building and having an external entry door 16. The core 14 provides space for water, sewage, breaker box, air conditioning, hot water heater, and any other like facilities. As all branch sewage lines extend through the wall of the core, the slab or floor of the building may be at a single elevation.

On the master bedroom side of the core the master bath 17 is provided with an entry way 18 into the master bedroom.

Within the master bath 17 there is located a tub and shower facility 19 which is raised to provide room for the conventional water trap therebelow above the foundation slab of the building. The slab is solid except for a sewer pipe extending up through the slab and at a single elevation; thus all of the sewage facilities are located so that their water traps are above the slab. The tub facility 19 is raised to make room for the water trap and a step 20 provides easy access to the tub.

Also within the master bath 17 there is located a wall mounted toilet 21 and one or more wall mounted lavatories 22.

The tub facility, the toilet and lavatories are arranged along the core wall 23 and their branch water and sewage lines extend through the wall 23.

Adjacent to the lavatories 22 and preferably opening into the hall is a washer and dryer closet, indicated generally at 24, having a dryer 25 and a clothes washer 26 therein. As the washer 26 is located immediately adjacent the lavatory 22, the plumbing for the washer may be associated with the lavatory plumbing.

On the side of the core 14 remote from the master bedroom 11, there is provided an auxiliary bath 27. As in the case of the master bath, the auxiliary bath has a bathing facility provided by the raised tub and shower 28. Also within the auxiliary bath there is a wall mounted toilet 29 and one or more wall mounted lavatories 31.

Associated with the family room 10 is a kitchen, indicated generally at 32. This kitchen has an L-shaped counter area, as indicated at 33, and a kitchen sink 34, as well as a dishwasher 35. The plumbing for the kitchen sink and dishwasher extends along the exterior wall 15, as will appear more fully hereinafter. Separating the kitchen from the family room is an island 36 in which the stove facility 37 may be provided.

Figure 2:
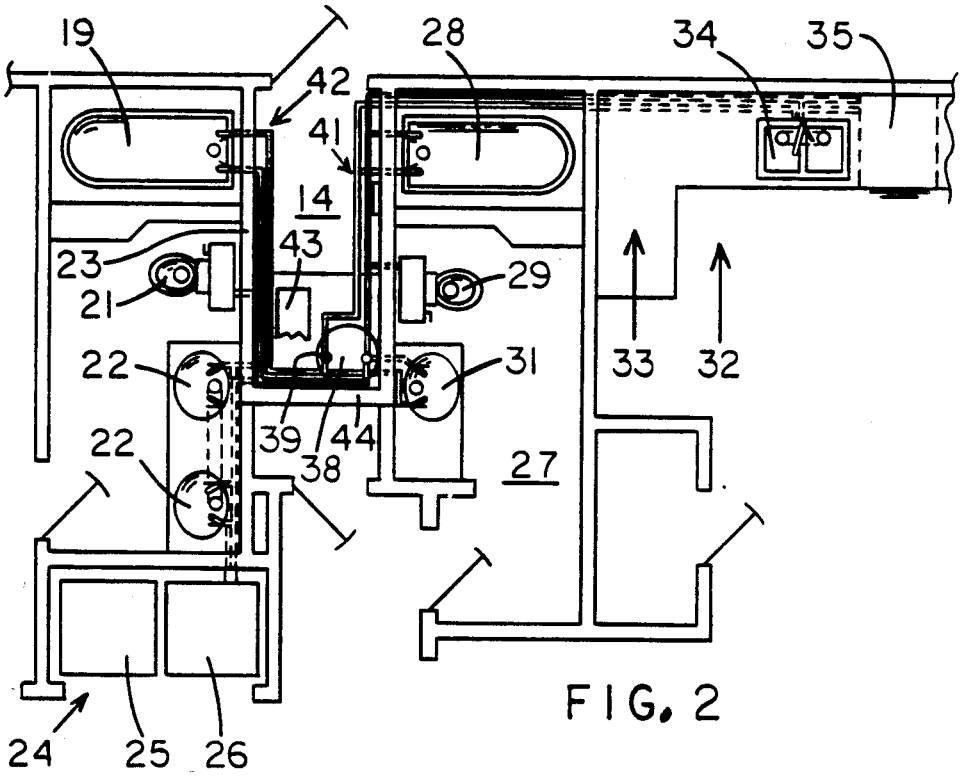
FIG. 2 is a view similar to FIG. 1 on an enlarged scale of the core, two baths and kitchen, illustrating pipe of hot and cold water to the several facilities.

The hot and cold water piping is illustrated in FIG. 2. A hot water heater 38 is located within the core 14 and suitable piping, indicated generally at 41, conducts water from the water inlet 39 and the hot water heater 38 to the auxiliary bath lavatory 31, commode 29, and bathing facility 28. This water piping also conducts water to the kitchen sink 34 and the dishwasher 35. Comparable water piping, indicated generally at 42, conducts water from the hot water heater and the water inlet 39 to the master bath bathing facility 19, toilet 21 and lavatories 22, as well as to the clothes washer 26.

In FIG. 2 the air handling equipment 43 is partially shown. This equipment preferably extends to the wall 44 and receives its intake air through this wall. The air outlets, not shown, extend through the attic in the conventional manner to the various rooms.

Figure 5:
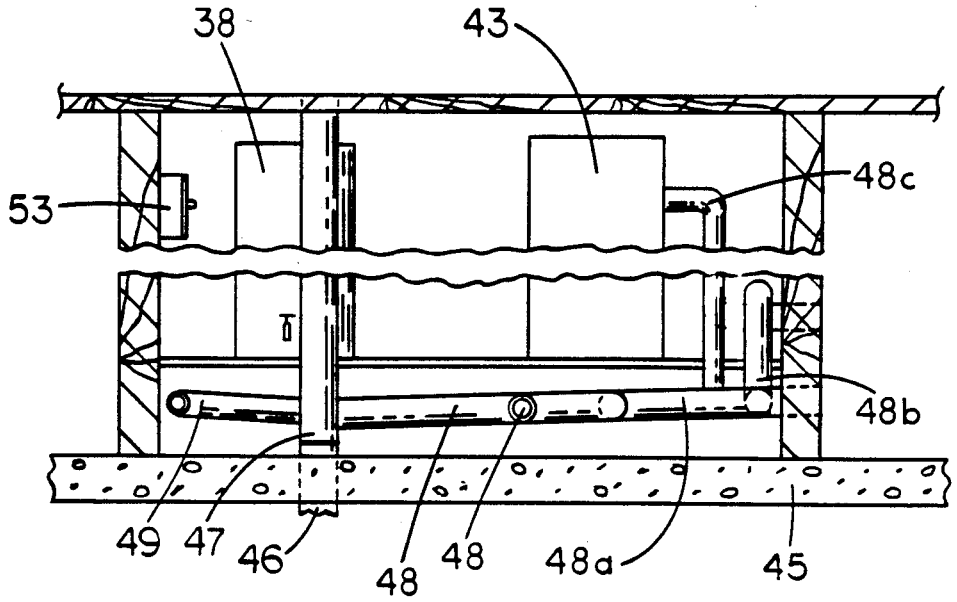
FIG. 5 is a view along the lines 5—5 of FIG. 3.

Referring now to FIGS. 3, 4 and 5, the waste water or sewage system is illustrated. The dwelling is preferably built on a slab 45 of concrete and a sewer line 46 extends down through the slab and conducts waste products from the dwelling. Connected to this sewer line is the main sewer pipe 47 which extends upwardly from the line 46 and extends out through the top of the dwelling, not shown, to provide a vent pipe, as is conventional.

Referring first to the master bath 17, waste from the bathing facility 19 passes through the conventional water trap 40 and thence through branch sewer conduit 48 to the main sewer line 47.

Waste water flows from the commode 21 through the branch sewer line **48*a* which joints with line 48 and thence to the main sewer line 47**.

Waste water from the two lavatories 22 and from the clothes washer 26 is conducted through the branch sewer line **48*b* which connects with sewer line 48*a* to convey waste water from these facilities. As shown in FIG. 5, these lines have a slight fall from the various fixtures to the main sewer line 47. Preferably, the lavatories and clothes washing machine are located most remote from the main sewer line 47** to take advantage of their higher trap locations to provide for the desired fall in the branch sewer line.

If air equipment 43 utilizes an evaporator, a drainage line **48*c* is extended from the evaporator to the main sewer line 47, preferably through the branch sewer line for the master bath. It may be connected to the sewer line 48*a*, as shown in FIG. 5**, if desired.

For the auxiliary bath, a branch line 49 is provided. The water trap 51 for the bathing facility 28 is connected to the branch line 49, as is the water trap 52 for the commode 29. The lavatory 31 may have its water trap 50 connected to the outlet from the commode 29, as indicated at 53.

The branch line 49 has an extension 49*a* which runs along the exterior wall 15 and connects with the kitchen sink 34 and the dishwasher 35, as shown in FIG. 3. As will appear in FIG. 4, all of the branch sewer line 49 has a slight fall toward the main sewer line 47. Again, by arranging the lavatory 31 remote from the main sewer line 47 along the wall of the core, adequate fall of the sewer line is present. Also, the dishwasher 35 will be connected to the kitchen sink 34 in the conventional manner in which the pump of the dishwasher drives its output into the water trap of the sink so that adequate fall will be present between the sink, dishwasher, and the main sewer line.

Viewing the core and associated baths and kitchens, as in FIG. 3, it will be noted that the core is an elongated rectangle with the fixtures of the two baths arranged along opposed parallel side walls with the fixtures having the higher trap locations located further away from the main sewer line 47. The sink 34 may be located in the kitchen at any desired point where it can be drained by the branch sewer line 49*a* extending parallel to the exterior wall 15 where room for the line is present behind the bathing fixture 28. With the baths, kitchen and various facilities arranged in the manner taught, a single main sewer line 47 can accommodate two full baths and a kitchen, thus eliminating the necessity for several main drain pipes servicing the dwelling with their attendant initial cost and subsequent maintenance cost.

In laying the slab 45 a hole for sewer line 46 may be provided by framing in a box one to two feet square. The position of the main sewer line 46 is not critical as each of the branch sewer lines may be adjusted in length to span the distance between the fixtures and main sewer line.

The foregoing disclosure and description of the invention are illustrative and explanatory thereof and various changes in the size, shape and materials, as well as in the details of the illustrated construction, may be made within the scope of the appended claims without departing from the spirit of the invention.

What is claimed is:

1. A dwelling comprising:

a living room and a plurality of bedrooms;

a utility core having a door opening through an exterior wall on one side of the dwelling;

first and second bathrooms on opposite sides of the core;

said first and second bathrooms having a wall provided by said exterior wall;

each bathroom including a toilet, at least one lavatory, and a bathing fixture;

a main sewer line in said core;

a first branch sewer line extending from the main sewer line to the toilet, lavatory, and bathing fixture of said first bathroom;

a second branch sewer line extending from the main sewer line to the toilet, lavatory, and bathing fixture of said second bathroom;

a clothes washing machine drain adjacent and connected to said first branch sewer line;

a kitchen on said exterior wall next to said second bathroom and having a kitchen sink; and a sewer line extending along said exterior wall through said second bathroom and connecting said sink to said main sewer line.

2. The dwelling of claim 1 wherein said kitchen sink is connected to said main sewer line through said second branch sewer line.

3. The dwelling of claim 1 wherein an air conditioning evaporator is located in said core and a drain line connects said evaporator to said main sewer line.

* * * * *